United States Patent [19]

Tagawa

[11] 4,224,967

[45] Sep. 30, 1980

[54] WARP TENSION CONTROL MECHANISM FOR LOOM

[75] Inventor: Naoji Tagawa, Kanazawa, Japan

[73] Assignee: Nissan Motor Company, Limited, Yokohama, Japan

[21] Appl. No.: 935,764

[22] Filed: Aug. 22, 1978

[30] Foreign Application Priority Data

Aug. 22, 1977 [JP] Japan ..... 52/99534

[51] Int. Cl.[2] ..... D03D 49/06

[52] U.S. Cl. ..... 139/108

[58] Field of Search ..... 139/105, 107, 108–110; 242/75.45; 66/212

[56] References Cited

U.S. PATENT DOCUMENTS

| | | | |
|---|---|---|---|
| 327,187 | 9/1885 | Middleton | 139/108 |
| 2,350,954 | 6/1944 | Brown | 139/108 |
| 3,567,354 | 3/1971 | Franssen et al. | 139/108 |

FOREIGN PATENT DOCUMENTS

| | | | |
|---|---|---|---|
| 861345 | 2/1961 | United Kingdom | 139/108 |

*Primary Examiner*—Henry Jaudon

*Attorney, Agent, or Firm*—Robert E. Burns; Emmanuel J. Lobato; Bruce L. Adams

[57] ABSTRACT

In order to keep the tensions applied to the warp yarns within a predetermined range throughout the weaving operation of the loom, an improved warp tension control mechanism is herein proposed which generally comprises a length regulating mechanism for regulating the length of the warp yarns fed from a yarn beam per unit time, a tension lever for applying tensions to the warp yarns by the aid of biasing mechanism, and a tension reducing mechanism which is operative to lessen the biasing force produced by the biasing mechanism thereby to reduce the tensions in the warp yarns in response to the continuous reduction of the outside diameter of the body of the warp yarns wound on the beam.

11 Claims, 8 Drawing Figures

WARP TENSION CONTROL MECHANISM FOR LOOM

The present invention relates in general to weaving looms and more particularly to a warp tension control mechanism for use in a loom.

It is an object of the present invention to provide a warp tension control mechanism for the weaving loom by which tensions imparted to warp yarns fed by the warp yarn supply means are maintained within a predetermined limited range automatically throughout the weaving proceeding of the loom.

According to the present invention, there is provided a warp yarn tension control mechanism for a loom having a warp yarn beam on which warp yarns are wound in a roll form, comprising in combination: a swingable elongage member having guide means over which the warp yarns fed from the beam are passed, the swingable elongate member being swingable about a fulcrum thereof in accordance with the degree of tensions applied to the warp yarns; biasing means for biasing the swingable elongate member to swing in a direction to apply via the guide means tensions to the warp yarns from the beam; regulating means for regulating the length of the warp yarns fed from the beam per unit time in accordance with the variation in swingable movement of the swingable elongate member; and tension reducing means for permitting the biasing means to produce reduced biasing force for the swingable elongate member in accordance with the reduction of the outside diameter of the body of the wound warp yarns on the beam so that the tensions applied to the warp yarns are kept within a predetermined limited range throughout the weaving operation of the loom.

Other objects and advantages of the present invention will become apparent from the following description when taken in conjunction with the accompanying drawings, in which.

Prior to describing the construction of the warp tension control mechanism of the present invention, explanation of a conventionally used warp tension control mechanism will be made with aid of FIG. 1 in order to clarify the inventive steps of the invention.

Figure 1:
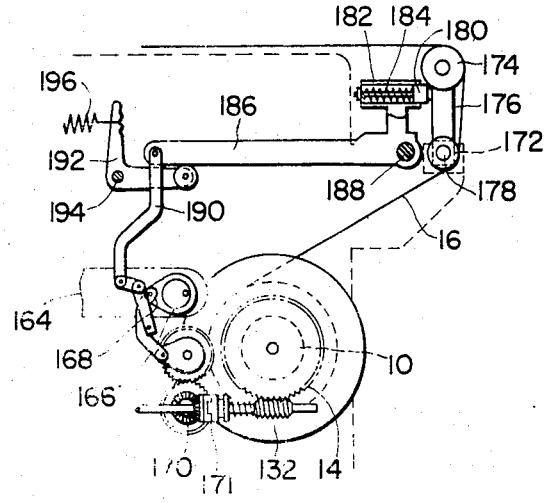
FIG. 1 PRIOR ART
FIG. 1 is a schematic side view showing a conventional warp tension control mechanism used in a weaving loom.

Referring to FIG. 1, there is schematically illustrated a conventional warp tension control mechanism which is disclosed clearly in Japanese Utility Model Publication No. 51-17332. The conventional mechanism shown in FIG. 1 is intended for use in a loom having a warp yarn supply means in which warp yarns are unwound and fed from the supply means via a drive device. A warp yarn beam 10 carries thereon warp yarns 16 and is driven by a driving mechanism comprising an endless belt 164 driven by a motor (not shown), variable speed gears 166 with a speed change arm 168, two intermeshing bevel gears 170, a clutch 171 and a worm gear 132 intermeshed with a worm wheel 14 coaxially fixed to the beam 10. The variable speed gears 166 are arranged as to increase the rotation speed of the bevel gears 170 and thus that of the yarn beam 10 as the speed change arm 168 stepwisely shifts downwardly in this drawing. The warp yarns 16 fed from the beam 10 are passed over a first guide roller 172 and a second guide roller 174 to healds (not shown) so as to form a shed to receive a weft yarn (not shown). The second guide roller 174 is rotatably supported on a free end of a swingable arm 176 which is swingable about a stationary shaft 178 to which the first guide roller 172 is coaxially and rotatably mounted. The swingable arm 176 is provided with a cylindrical boss or projection 180 which is slidably received in a cylinder 182. Spring means 184 is received in the cylinder 182 to bias the boss 180 to move rightwardly in the drawing. The cylinder 182 is secured to a supported end portion of a tension lever 186 which is swingable about a shaft 188. The free end of the tension lever 186 carries a swingable linkage 190 which leads to the above-mentioned speed change arm 168. An L-shaped lever 192 is swingably supported on a stationary pin 194 to bias the tension arm 186 to rotate in the clockwise direction about the shaft 188 by aid of a spring 196. The swingable arm 176 is thus always biased to rotate clockwise thereby tensioning the warp yarns 16 via the second guide roller 174.

As the warp yarns 16 are unwound from the yarn beam 10 by the driving device, the outside diameter of the body of the wound yarns 16 on the beam 10 decreases from one layer of the yarns to another so that the length of the yarns unwound from the yarn beam 10 per rotation of the beam decreases to cause the tensions in the yarns to continuously increase as the weaving operation proceeds. The continuously increasing tensions in the warp yarns 16 causes the swingable arm 176 to gradually rotate counterclockwisely turning the tension lever 186 counterclockwisely against the biasing force of the spring 196. With this turning of the tension lever 186, the linkage 190 moves downwardly to stepwisely shift the speed change arm 168 downwardly, thus increasing the rotation speed of the yarn beam 10 with a result that increased length of the unwound warp yarns 16 per unit time is fed from the beam 10 to decrease the tension in the warp yarns 16 thereby permitting the swingable arm 176 to rotate in a clockwise direction toward its original position. Similar operations to the above continue throughout the weaving of the loom to compensate for the increase in the tension in the warp yarns.

The conventional mechanism of the above, however, has a problem which originates from the variation in the outside diameter of the body of the wound warp yarns 16 on the beam 10. During operation, the speed change arm 168 is caused to stepwisely shift downwardly without returning upwardly. This is because the rotation speed of the beam 10 which has been momentarily set by the variable speed gears 166 is kept constant until the next compensation operation inducing increased speed of the same is provided by the mechanism. This means that the compensation operation will take place when degree of the tension applied to the warp yarns 16 exceeds that of tensions momentarily applied to the warp yarns 16. Thus, in fact, the maximum tension applied to the warp yarns gradually increases as the above-mentioned compensation operations continuously take place. Hitherto, such problem is solved by changing the linkage 190 with another linkage of longer length at regular intervals during the weaving operation of the loom. However, it is clear such changing of the linkage is troublesome thus decreasing the fabric production efficiency of the loom.

The present invention can solve the troublesome linkage change encountered in the above-mentioned conventional mechanism.

Figure 2:
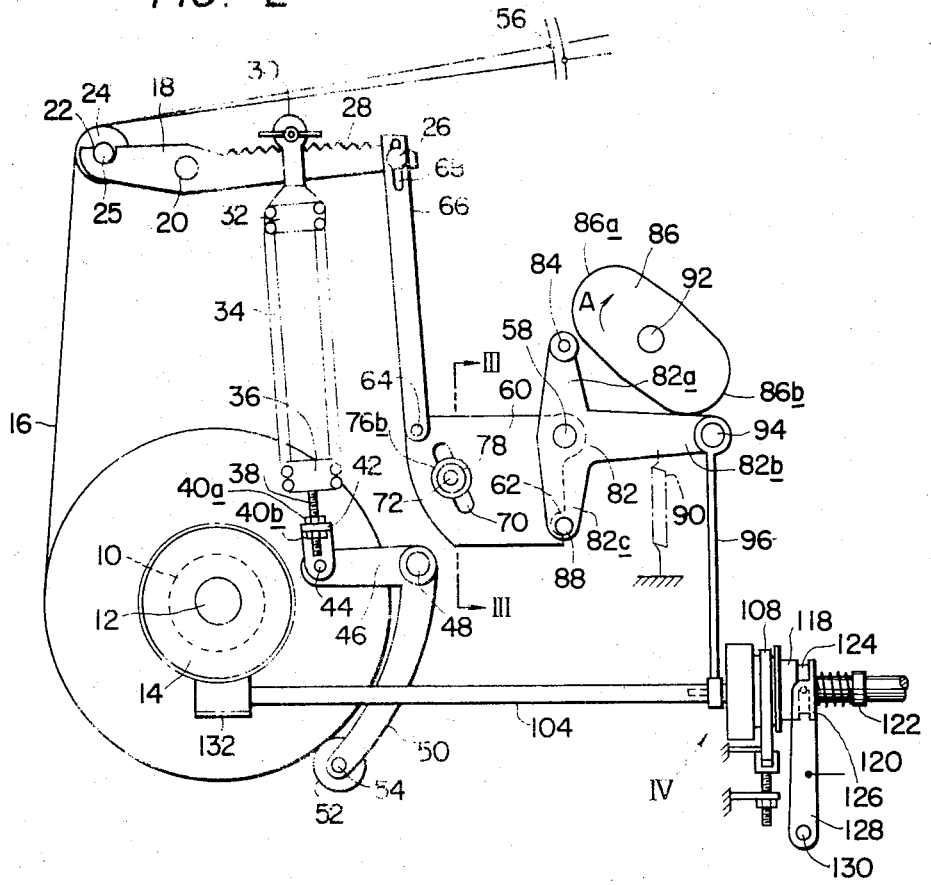
FIG. 2 is a schematic side view showing a first preferred embodiment of the warp tension control mechanism according to the present invention.

Referring to FIGS. 2 to 5, especially to FIG. 2, there is illustrated a warp tension control mechanism arranged for a loom. A warp yarn beam 10 has a shaft 12 coaxially passing therethrough and journaled on a stationary frame structure (not shown) of the loom. Coaxially secured to the shaft 12 is a worm wheel 14. The beam 10 carries warp yarns 16 which are wound on the beam 10 in a roll form. Above the warp yarn beam 10 is positioned a tension lever 18 which is pivotally supported on a stationary pin 20 secured to the stationary frame structure. The tension lever 18 has at its left end a recess 22 in which a roller 24 is rotatably received via a shaft 25 and at its right end a headed pin 26 secured thereto. The tension lever 18 is formed at a portion thereof between the pin 20 and the headed pin 26 with zig-zag or saw-tooth shaped recesses 28. Hanging from the saw-tooth shaped portion of the lever 18 through a hook 30 is a retainer 32 which is fixed to an upper end of a tension spring 34. The lower end of the tension spring 34 is equipped with another retainer 36 from which a threaded bolt 38 extends downwardly. The bolt 38 is adjustably fixed, by means of nuts **40*a* and 40*b*, to a holder 42 which is rotatably supported on a pin 44 fixed to a left end of an arm 46. The arm 46 is secured at its right end to a rotatable shaft 48 journaled on the stationary frame structure. A feeler lever 50 is secured at its one end to the rotatable shaft 48 so as to be rotatable with the arm 46 about the axis of the shaft 48. A feeler roller 52 is rotatably supported on a pin 54 fixed to the other end of the feeler lever 50. The feeler roller 52 runs on the outer cylindrical surface of the body of the warp yarns on the beam 10 as shown. The warp yarns 16 from the beam 10 are passed over the roller 24 to healds 56 so as to form a shed (not shown) to receive a weft yarn (not shown). Thus, it should be appreciated that by the tension spring 34, the tension lever 18 is biased to rotate about the pin 20 in a clockwise direction thereby applying tensions to the warp yarns 16 via the roller 24, and simultaneously the arm 46 and thus the feeler lever 50 are biased to rotate about the axis of the rotatable shaft 48 in a clockwise direction thereby pressing the feeler roller 52 against the body of the warp yarns 16 on the yarn beam 10**.

Figure 3:
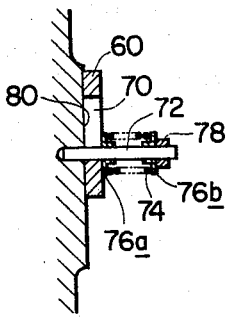
FIG. 3 is a sectional view taken on the line III—III of FIG. 2.

Designated by numeral 58 is a stationary shaft fixed to the stationary frame structure of the loom. Rotatably supported at its right-upper corner on the shaft 58 is a generally rectangular plate member 60 which has a semicircular recess 62 at the right-lower corner thereof and further a pin 64 fixed to the left-upper corner thereof. A connecting rod 66 is pivotally connected at the lower end thereof to the pin 64. The upper end of the rod 66 is formed with a longitudinally extending slot 68 through which the before-mentioned headed pin 26 passes so that lost motion displacement between the rod 66 and the tension lever 18 is given. The rectangular plate member 60 is formed at a left portion thereof with an elongate arcuate slot 70 which has a center of curvature concentric with the center of the shaft 58. As is best seen in FIG. 3, the elongate slot 70 of the plate member 60 slidably receives therein a pin 72 which is secured at its one end to the stationary frame structure of the loom. A compression spring 74 having retainers **76*a* and 76*b* is disposed about the pin 72 and between the plate member 60 and a stopper 78 fixed to the other end of the pin 72 so that the plate member 60 is biased to press against a flat surface 80** defined on the stationary frame structure of the loom.

Figure 4:
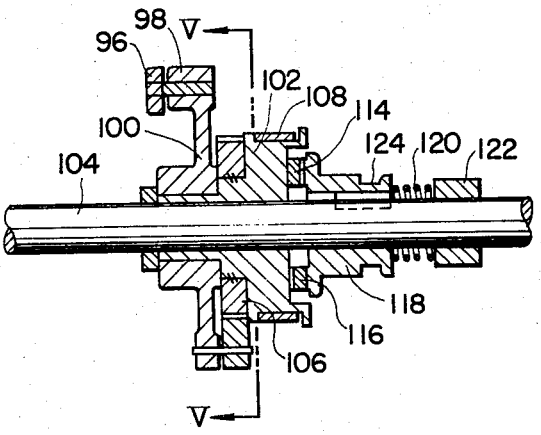
FIG. 4 is a sectional elevation view of a part indicated by line IV of FIG. 2.
Figure 5:
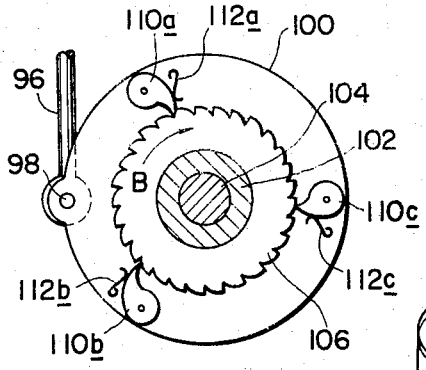
FIG. 5 is a view taken on line V—V of FIG. 4.

Referring again to FIG. 2, a T-shaped lever 82 with first, second and third arm portions **82*a*, 82*b* and 82*c* is pivotally supported on the before-mentioned shaft 58 juxtaposed the plate member 60. The first arm portion 82*a*, which extends upwardly, is equipped at the leading end thereof with a cam follower 84 which is rotatably engageable with lobe portions 86*a* and 86*b* of a cam 86 in a manner as will be described hereinlater. The third arm portion 82*c*, which extends downwardly, is equipped with a pin 88 extending perpendicularly with respect to the surface of this drawing (FIG. 2), the pin 88 being received in the semi-circular recess 62 of the plate member 60. A spring 90 connected at its lower end to the stationary frame member is fixed at the upper end to the second arm portion 82*b* so as to bias the T-shaped lever 82 to rotate in a clockwise direction thereby pressing the pin 88 into the semi-circular recess 62. The cam 86 is securely mounted on a shaft 92 which rotates in the direction of the arrow A and for example ½ turn per one picking action of the loom. As will become clear hereinlater, the cam follower 84 on the T-shaped lever 82 is engageable with only the lobe portions 86*a* and 86*b* of the cam 86. The second arm portion 82*b* of the T-shaped lever 82 is equipped at its leading end with a pin 94 about which an upper end of a connecting rod 96 is rotatably disposed. As is seen from FIGS. 4 and 5, the lower end of the connecting rod 96 is rotatably connected to a boss 98 formed on a peripheral portion of a circular plate 100. As is seen from FIG. 4, the circular plate 100 is rotatably and coaxially disposed about the smallest diameter bearing section of a collar 102. The collar 102 is rotatably disposed about a driven shaft 104 and is further formed with the medium and large diameter bearing sections, as shown. A ratchet wheel 106 is securedly disposed on the medium diameter bearing section and a braking band 108 is disposed on the largest section to appropriately apply friction braking force to the collar 102. As is seen in FIG. 5, three ratchets 110*a*, 110*b* and 110*c* are swingably connected to the peripheral portion of the circular plate 100 at evenly spaced intervals, on the side juxtaposed the ratchet wheel 106. These ratchets 110*a*, 110*b* and 110*c* are biased to rotate in clockwise direction by plate springs 112*a*, 112*b* and 112*c* so as to be brought into engagement with the teeth of the ratchet wheel 106. As is shown in FIG. 4, the right side of the collar 102 is formed with teeth 114 which are meshingly engageable with teeth 116 formed in a left side of a sleeve 118. The sleeve 18 is in splined connection with the driven shaft 104 so that the sleeve 118 can move longitudinally along the shaft 104 and rotation of the sleeve 118 about the axis thereof turns the shaft 104. The sleeve 118 is biased to move leftwardly to meshingly engage with the collar 102 by means of a spring 120 which is disposed about the shaft 104 between the sleeve 118 and a stopper 122 secured to the shaft 104. The sleeve 118 is formed with an annular groove 124 therearound. As is shown in FIG. 2, the annular groove 124 receives two pins 126 (one of which is shown) fixed to a fork portion formed on a lever 128**.

The lever 128 is pivotally supported on a stationary pin 130 and is connected through a suitable linkage (not shown) to a suitable pedal (not shown) so that the clockwise movement of the lever 128 due to the operation of the pedal against the force of the spring 120 induces disengagement of the sleeve 118 from the collar 102. Under this disengagement, the shaft 104 can be rotated by a manually operating handle (not shown) without engaging with the collar 102. Now, it should be noted that during the engagement of the sleeve 118 and the collar 102, swingable movements of the circular plate 100 due to reciprocating movements of the connecting rod 96 will periodically rotate the ratchet wheel 106 and thus the collar about the shaft 104 in the direction of the arrow B (FIG. 5) because of the provision of the ratchets 110*a*, 110*b* and 110*c* engaging the teeth of the ratchet wheel 106. Thus, the oscillation of the circular plate 100 will cause the rotation of the shaft 104 in the direction of the arrow B (FIG. 5) when the sleeve 118 is in meshing connection with the collar 102. The leading end of the shaft 104 is equipped with a worm gear 132 which is operatively engaged with the before-mentioned worm wheel 14. Although not shown in the drawings, suitable numbers of bearings for the shaft 104 are used in a conventional manner. From the above, it is to be noted that the counterclockwise rotation of the tension lever 18 to some extent does not permit the headed pin 26 thereon to reach the upper end of the elongated slot 68 so that the connecting rod 66 and thus the rectangular plate member 60 do not move, and the rotation of the tension lever 18 exceeding a predetermined level permits the pin 26 to be brought into contact with the upper end of the elongate slot 68 to lift the connecting rod 66 upwardly rotating the plate member 60 in the clockwise direction.

Under weaving operation of the loom, the T-shaped lever 82 is kept in a position where the cam follower 84 on the first arm portion 82*a* is engageable with the lobe portions 86*a* and 86*b* of the rotating cam 86 inducing swingable movements of the T-shaped lever 82 by the aid of the spring 90. The swingable movements of the T-shaped lever 82 induce periodic upward and downward or reciprocating movements of the connecting rod 96 thereby oscillating the circular plate 100 about the collar 102 so that the ratchet wheel 106 periodically rotates in the direction of the arrow "B". The rotation of the ratchet wheel 106 causes the rotation of the driven shaft 104 about the axis thereof in the direction of "B" when the sleeve 118 is intermeshed with the collar 102. Thus, the worm gear 132 on the driven shaft 104 rotates the yarn beam 10 in the clockwise direction in FIG. 2 to feed the warp yarns 16 therefrom.

As the warp yarns 16 are unwound from the yarn beam 10 in the above-mentioned manner, the outside diameter of the body of the wound warp yarns 16 in the roll form on the beam 10 decreases from one layer of the yarns to another so that the length of the yarns 16 unwound from the beam 10 per turn of the beam 10 decreases to cause the tensions in the warp yarns 10 to continuously increase as the weaving operation of the loom proceeds. Thus, the tension lever 18 gradually swings about the pin 20 in the counterclockwise direction and finally causes the headed pin 26 thereon to be brought into engagement with the upper end of the elongate slot 68 formed in the connecting rod 66 to lift the rod 66 upwardly. Thus, the rectangular plate member 60 rotates to some extent about the shaft 58 in the clockwise direction. Thus, the angular displacement of the T-shaped lever 82 in the clockwise direction is permitted to increase since the rectangular plate member has assumed a new position which permits the pin 88 to move further to the left (as seen in FIG. 2) before coming into engagement with the semi-circular recess 62. Thus, the stroke or amplitude of the movement of the rod 96 accordingly increases the degree of rotation of the ratchet wheel 106. This of course increases the rotation speed of the driven shaft 104 in the direction of the arrow "B" per stroke of the rod 96. Thus, as the rotation speed of the driven shaft 104 increases, the length of the warp yarns 16 unwound or fed from the yarn beam 10 per unit time increases so as to compensate for the increase in the tensions in the warp yarns 16. As this compensation occurs, the tension lever 18 returns to a position thereof wherein the headed pin 26 thereon is separated from the upper end of the elongate slot 68 of the rod 66. It should be noted, however, that the newly set rotation speed of the driven shaft 104 is kept constant until the next movement of the rectangular plate member 60 takes place. This is because the rectangular plate member 60 is maintained in position until moved as a result of rotation of the tension lever 18 by the clamping effect produced by the arrangement of the spring 74 between the plate member 60 and the flat surface 80 of the stationary frame structure of the loom. Thus, during the operation of the loom, the connecting rod 66 is steadily moved upwardly, so that the position of the tension lever 18 at which the headed pin 26 on the lever 18 is brought into contact with the upper end of the elongate slot 68 to move the connecting rod 66 up causing increase in the rotation speed of the driven shaft 104, moves upwardly with respect to the loom frame. In the case the lower end of the tension spring 34 is connected to some stationary member such as the frame structure of the loom, however unlike the connection hereafter disclosed, the above-mentioned compensation operation will take place when the degree of the tensions applied to the warp yarns 16 exceeds that of the tension which was previously applied to the warp yarns 16 and which determined the present rotational speed of shaft 104 via the after-described compensation. Thus, if the lower end of the tension spring 34 is connected to some stationary member, the degree of the tension applied to the spring and consequently applied to the warp yarns 16 gradually increases even though the above-mentioned compensation operations are completely made. This problem may be somewhat solved by changing the connecting rod 66 with one having shorter length. But, such changing of the rod 66 is troublesome to cause decrease in fabric production efficiency of the loom.

According to the first embodiment of the invention, shown in FIG. 2, such trouble is solved by connecting the lower end of the tension spring 34 to movable means which moves in response to decrease in the outside diameter of the body of the wound warp yarns 16 on the yarn beam 10. As is understood now, the movable means comprises the retainer 36, bolt 38, holder 42, arm 46, shaft 48, feeler lever 60 and feeler roller 52. In operation, the outside diameter of the body of the wound yarns on the beam 10 gradually decreases causing rotation of the feeler lever 50 in the clockwise direction with the arm 46, so that the retainer 36 fixed to the lower end of the tension spring 34 gradually shifts upwardly, that is in a direction to decrease the length of the elongated tension spring 34. By suitably selecting the lengths of the arm 46 and the feeler lever 50, it becomes possible to maintain the length of the tension spring 34 constant during the operation of the loom. Thus, compensation for the increase in the tensions in the spring 34 and consequently in the warp yarns 16 is completely and automatically achieved.

Figure 6:
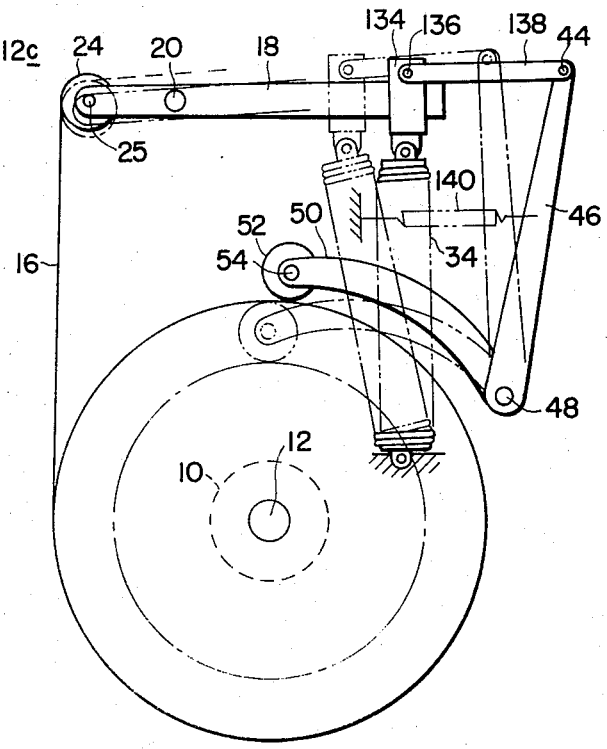
FIGS. 6 to 8 are schematic side views respectively showing tension reducing means of second, third and fourth preferred embodiments of the warp tension control mechanism of the present invention.

Referring to FIG. 6, there is shown another movable means which can move in accordance with decrease in the outside diameter of the body of the wound yarns 16 on the yarn beam 10. For facilitation of the drawing and description, substantially the same parts will be denoted by the same numerals as in the case of FIG. 2 and detailed explanation of which will be omitted from the following. The movable means herein shown comprises a slider 134 which is mounted on the tension lever 18 to be longitudinally slidable thereon. The slider 134 is equipped at its upper end with a pin 136 which pivotally supports one end of a connecting rod 138. The other end of the rod 138 is pivotally connected via the pin 44 to an upper end of the arm 46. As has been mentioned before, the arm 46 is secured to the shaft 48 to which the feeler lever 50 with the feeler roller 52 is also secured, so that the arm 46 and the feeler lever 50 can simultaneously rotate about the axis of the shaft 48 without changing the angle defined therebetween. A spring 140 is fixed to the arm 46 to bias the same to rotate in the counterclockwise direction thereby passing the feeler roller 52 on the feeler lever 50 against the body of the wound yarns 16 on the yarn beam 10. The tension spring 34 is pivotally fixed at its upper end to a lower end of the slider 134 and at its lower end to the stationary frame structure of the loom.

As the outside diameter of the body of the wound yarns 16 on the yarn beam 10 decreases in response to the weaving operation of the loom, the feeler lever 50 and thus the arm 46 gradually rotate in the counterclockwise direction about the axis of the shaft 48 as being shown by phantom lines. Thus, the slider 134 is caused to move on the tension lever 18 in the leftward direction that is toward the pin 20 so that the moment imparted by the tension spring 34 to the tension lever 18 for rotation of the same about the pin 20 in the clockwise direction decreases. Thus, the compensation for the increase in the tension in the warp yarns 16 is completely and automatically made.

Figure 7:
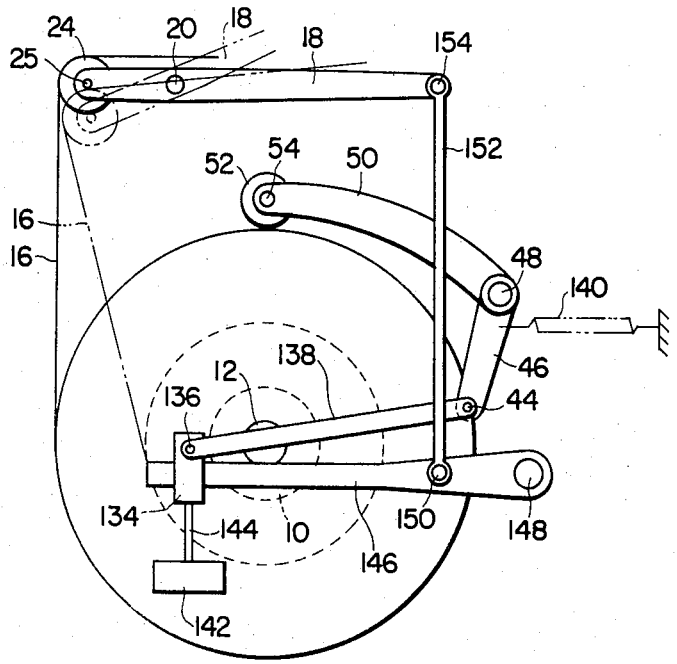

Referring to FIG. 7, there is shown a mechanism by which the complete compensation for the tension increase in the warp yarns 16 is also automatically achieved. For facilitation of the drawing and description, substantially the same parts will be denoted by the same numerals as in the case of FIG. 6 and detailed explanation of which will be omitted from the following. The mechanism herein disclosed comprises a weight 142 which is fixed to the slider 134 via rod 144. The slider 134 is mounted on a lever 146 so as to be longitudinally slidable thereon. The lever 146 is swingably mounted at its right end to a shaft 148 fixed to the stationary frame structure of the loom. The slider 134 has the pin 136 which pivotally mounts one end of the connecting rod 138. The rod 138 is pivotally connected at its right end, via the pin 44, to a lower end of the arm 46. The arm 46 is secured at its upper end to the rotatable shaft 48 supported by the stationary frame structure of the loom. The feeler lever 50 on which the feeler roller 52 is rotatably mounted is secured to the shaft 48 so as to rotate with the arm 46 about the axis of the shaft 48. The lever 146 is fixed with a pin 150 to which a lower end of a rod 152 is pivotally connected. The rod 152 is pivotally connected at its upper end to the right end of the tension lever 18 via the pin 154. The spring 140 fixed at one end to the stationary frame structure of the loom is connected to the arm 46 to bias the same and thus the feeler lever 50 to rotate in the counterclockwise direction about the axis of the shaft 48 thereby pressing the feeler roller 52 against the body of the wound yarns 16 on the beam 10. With the above, it should be noted that the provision of the weight 142 induces a condition in which the lever 146 is biased to rotate in the counterclockwise direction about the shaft 148 and thus, through the rod 152, the tension lever 18 is biased to rotate in the clockwise direction about the pin 20 applying tension to the warp yarns 16 supplied from the yarn beam 10. Furthermore, it should be noted that during weaving operation of the loom, the tension lever 18 will swing to take such a position as indicated by broken lines inducing the upward shifting of the actuation position of the tension lever 18 against the connecting rod 66 (not shown in this drawing).

The mechanism of this third embodiment operates as follows.

As the outside diameter of the body of the wound yarns 16 on the beam 10 decrease in response to the weaving operation of the loom, the feeler lever 50 and thus the arm 46 gradually rotate under the influence of the spring 140 in the counterclockwise direction about the axis of the shaft 48 thereby pulling the slider 134 along the lever 146 toward the shaft 148, so that the moment imparted by the weight 142 to the lever 146 for rotation of the same decreases. Thus, the moment imparted by the rod 152 to the tension lever 18 for rotation of the same in the clockwise direction about the pin 20 decreases thereby decreasing the tension applied to the warp yarns 16.

Figure 8:
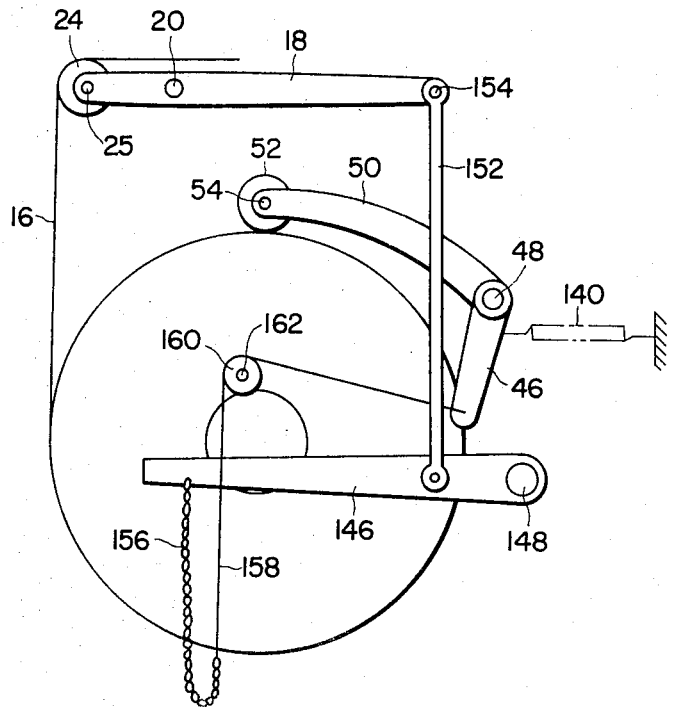

Referring to FIG. 8, there is illustrated another mechanism by which the complete compensation for the tension increase in the warp yarns 16 is also automatically achieved. For facilitation of the drawing and description, substantially the same parts will be designated by the same numerals as in the case of FIG. 7 and detailed explanation of which will be omitted from the following. The mechanism hereindisclosed comprises generally the same parts as in the mechanism of FIG. 7 with an exception of several parts. An elongate flexible weight member 156 (such as a chain), a rope 158 or line and a guide roller 160 are used as a substitute for the weight 142, slider 34 and the rod 138 of the mechanism of FIG. 7. As shown, the elongate flexible weight member 156 is fixed at its one end to a free end portion of the lever 146 and at the other end to the rope 158 which is passed over the guide roller 160 to the lower end of the arm 46. As shown, the weight member 156 is hung from the lever 146 in a manner that the lower end portion thereof is supported by the rope 158. The guide roller 160 is rotatably connected to the stationary frame structure of the loom via a pin 162.

Operation is as follows:

As the outside diameter of the body of the wound yarns 16 on the beam 10 decreases in response to the operation of the loom, the feeler lever 50 and thus the arm 46 gradually rotate in the counterclockwise direction by the force of the spring 140 thereby lifting up the lower end portion of the elongated frexible weight member 156 via the rope 158. Thus, the weight applied to the free end portion of the lever 146 is gradually decreased, so that the moment imparted by the rod 152 to the tension lever 18 for rotation of the same in the clockwise direction about the pin 20 decreases thereby decreasing the tensions applied via the roller 24 to the warp yarns 16 from the yarn beam 10. Thus, the compensation for the increase in the tensions in the warp yarns 16 is completely and automatically made.

From the foregoing description, it will be appreciated that since the warp tension control mechanism of the present invention is provided with means which can decrease or adjust the tension applied by the tension lever to the warp yarns in accordance with the decrease in outside diameter of the body of the wound warp yarns on the yarn beam, the tension in the warp yarns is kept substantially constant or at least within a predetermined limited range throughout, automatically.

It should be noted that the foregoing description shows only four embodiments, various modifications are apparent to those skilled in the art without departing from the scope of the invention which is only limited by the appended claims.

What is claimed is:

1. A warp tension control mechanism for a loom having a warp yarn beam on which warp yarns are wound in a roll form, comprising:

a swingable elongate member having guide means over which the warp yarns fed from said beam pass, said swingable elongate member being swingable about a fulcrum thereof in accordance with the degree of tensions applied to said warp yarns fed from said beam;

biasing means for biasing said swingable elongate member to swing in a direction to apply via said guide means tensions to said warp yarns;

a first member having at one end an elongate slot, a pin extending through said slot fixed to said swingable elongate member at a location opposite to said guide means with respect to said fulcrum spacedly so that the swingable movement of said swingable elongate member in said direction beyond a given degree brings said pin into contact with an end of said elongate slot to move said first member in one direction;

a second member pivotally supported on a stationary member of said loom and having an end pivotally connected to the other end of said first member, said second member being provided with position holding means for holding said second member in a selected angular position;

a third member pivotally supported on said stationary member and having an end engageable with a portion of said second member so that the degree of the pivotal movement of said third member in one direction depends on the degree of the pivotal displacement of said second member induced by the movement of said first member in said one direction;

a fourth member having a portion periodically engageable with a portion of said third member under rotation thereof to cause swinging movements of said third member;

converting means for converting said swinging movements of said third member to a rotational movement of said beam in a direction to feed said warp yarns therefrom such that the rotation speed of said beam depends on the degree of the swinging movements of said third member; and tension reducing means for permitting said biasing means to produce reduced biasing force for said swingable elongate member in accordance with the reduction of the outside diameter of the body of the wound warp yarns on said beam so that the tensions applied to said warp yarns are kept within a predetermined limited range throughout the weaving operation of the loom.

2. A warp tension control mechanism as claimed in claim 1, in which said biasing means is a spring having one end connected to a portion of said swingable elongate member, said portion being opposite to said guide means with respect to said fulcrum and in which said tension reducing means comprises a swingable lever unit having one end thereof connected to the other end of said spring and the other end thereof contacting via feeler means to the outer cylindrical surface of the body of said warp yarns wound on said beam, said swingable lever unit being rotatable about a portion defined between said ends in such manner that the rotation of said swingable lever unit in one direction induced by the decrease of the outside diameter of said body of said warp yarns wound on the beam causes said spring to generate reduced biasing force thereby reducing the tensions in the warp yarns extending from said beam.

3. A warp tension control mechanism as claimed in claim 1, in which said biasing means is a spring having one end connected to a stationary member of said loom and in which said tension reducing means comprises a slider member longitudinally slidably mounted on said swingable elongate member opposite to said guide means with respect to said fulcrum, said slider member being pivotally fixed to the other end of said spring; a swingable lever unit having one end thereof connected through a connecting rod to said slider member and the other end thereof contacting via feeler means the outer cylindrical surface of the body of said warp yarns wound on said beam, said swingable lever unit being rotatable about a portion defined between said ends in such a manner that a rotation of said swingable lever unit induced by the decrease of the outside diameter of the body of said wound warp yarns on the beam causes said slider member to move on said swingable elongate member toward said fulcrum.

4. A warp tension control mechanism as claimed in claim 1, in which said biasing means comprises a weight and in which said tension reducing means comprises a swingable lever member swingable about one end thereof; a slider member longitudinally slidably mounted on said swingable lever member, said slider member supporting said weight; a swingable lever unit having one end thereof connected through a first connecting rod to said slider member and the other end thereof contacting via feeler means the outer cylindrical surface of the body of said warp yarns wound on the beam; a spring for urging said swingable lever unit to rotate in a direction to press said feeler means against the outer cylindrical surface of said body; and a second connecting rod pivotably connecting said swingable lever member at a location between the pivoted end of the same and the slider member to a portion of said swingable elongate member at a location opposite to the guide means with respect to said fulcrum, said swingable lever unit being rotatable about a portion thereof other than said both ends in such a manner that the rotation of said swingable lever unit in one direction induced by the decrease of the outside diameter of the body of said wound warp yarns on the beam by the aid of the biasing force produced by said spring causes said slider member to move on said swingable elongate member toward said one end of the same.

5. A warp tension control mechanism as claimed in claim 1, in which said biasing means is an elongated flexible weight member and in which said tension reducing means comprises a swingable lever member swingable about one end thereof, the free end of said swingable lever member being fixed with one end of said elongated flexible weight member; a connecting rod pivotally connecting said swingable lever member at a location between the pivoted end of the same and said free end of the same to a portion of said swingable elongate member at a location opposite to the guide means with respect to said fulcrum; a swingable lever unit having one end thereof contacting via feeler means the outer cylindrical surface of the body of said wound warp yarns on the beam; a flexible rope connecting the other end of said swingable lever unit to the other end of said elongated flexible weight member; rope guide means for guiding said rope so as to lift up the other end of said elongated flexible weight member as said swingable lever unit rotates in a direction about a portion thereof other than said both ends; and a spring for urging said swingable lever unit to rotate in a direction to press said feeler means against the outer cylindrical surface of said body; said swingable lever unit being rotatable about said portion thereof in such a manner that the rotation of said swingable lever unit in said the direction is caused by the reduction of the outside diameter of the body of the wound warp.yarns on the beam by the aid of the biasing force produced by said spring.

6. A warp tension control mechanism as claimed in claim 1, further comprising a spring for biasing said third member to swing in a direction to cause said end of said third member to abut on said portion of said second member.

7. A warp tension control mechanism as claimed in claim 6, in which said second member has an elongate slot and in which said position holding means comprises:

a pin fixed to said stationary member and passing spacedly through said elongate arcuate slot formed in said second member; and a spring disposed about said pin and compressed between an outer face of said second member and a head section of said pin.

8. A warp tension control mechanism as claimed in claim 7, in which said elongate arcuate slot in said second member has a center of curvature at a portion where said second member is pivoted to said stationary member.

9. A warp tension control mechanism as claimed in claim 8, in which the pivotal connections between said second member and the stationary member and between said third member and the stationary member comprise a common shaft.

10. A warp tension control mechanism for a loom having a warp yarn beam on which warp yarns are wound in a roll form, comprising in combination:

a swingable elongate member having guide means over which the warp yarns fed from said beam pass, said swingable elongate member being swingable about a fulcrum thereof in accordance with the degree of tensions applied to said warp yarns fed from said beam;

biasing means for biasing said swingable elongate member to swing in a direction to apply via said guide means tensions to said warp yarns;

regulating means for regulating the length of the warp yarns fed from said beam per unit time in accordance with the variations in swingable movement of said swingable elongate member; and tension reducing means for permitting said biasing means to produce reduced biasing force for said swingable elongate member in accordance with the reduction of the outside diameter of the body of the wound warp yarns on said beam so that the tensions applied to said warp yanrs are kept within a predetermined limited range throughout the weaving of the loom, wherein said biasing means is a spring having one end connected to a stationary member of said loom and wherein said tension reducing means comprises a slider member longitudinally slidably mounted on said swingable elongate member at the opposite position of said guide means with respect to said fulcrum, said slider member being pivotally fixed to the other end of said spring, a swingable lever unit having one end thereof connected through a connecting rod to said slider member and the other end thereof contacting via feeler means the outer cylinder surface of the body of said warp yarns wound on said beam, said swingable lever unit being rotatable about a portion defined between said ends of the swingable lever unit in such a manner that a rotation of said swingable lever unit induced by the reduction of the outside diameter of the body of the wound warp yarns on the beam causes said slider member to slide on said swingable elongate member toward said fulcrum.

11. A warp tension control mechanism for a loom having a warp yarn beam on which warp yarns are wound in a roll form, comprising in combination:

a swingable elongate member having guide means over which the warp yarns fed from said beam pass, said swingable elongate member being swingable about a fulcrum thereof in accordance with the degree of tensions applied to said warp yarns fed from said beam;

biasing means for biasing said swingable elongate member to swing in a direction to apply via said guide means tensions to said warp yarns;

regulating means for regulating the length of the warp yarns fed from said beam per unit time in accordance with the variations in swingable movement of said swingable elongate member; and tension reducing means for permitting said biasing means to produce reduced biasing force for said swingable elongate member in accordance with the reduction of the outside diameter of the body of the wound yarns on said beam so that the tensions applied to said warp yarns are kept within a predetermined limited range throughout the weaving operation of the loom, wherein said biasing means is an elongated flexible weight member and wherein said tension reducing means comprises a swingable lever member swingable about one end thereof, the free end of said swingable lever member being fixed to one end of said elongated flexible weight member; a connecting rod pivotally connecting said swingable lever member at a location between the pivoted end of the same and said free end of said same to a portion of said swingable elongate member at a location opposite to the guide means with respect to said fulcrum, a swingable lever unit having one end thereof contacting via feeler means the outer cylindrical surface of the body of the wound warp yarns on the beam; a flexible rope connecting the other end of said swingable lever unit to the other end of said elongated flexible weight member; rope guide means for guiding said rope so as to lift up the other end of said elongated flexible weight member as said swingable lever unit rotates in a direction about a portion thereof other than the both ends of said swingable lever unit, and a spring for urging said swingable lever unit to rotate in a direction to press said feeler means against the outer cylindrical surface of said body, said swingable lever unit being rotatable about said portion thereof in such a manner that the rotation of said swingable lever unit in said direction is caused by the reduction of the outside diameter of the body of the wound warp yarns on the beam by the aid of the biasing force produced by said spring.

* * * * *